US006096440A

United States Patent [19]

Moriya et al.

[11] Patent Number: 6,096,440

[45] Date of Patent: Aug. 1, 2000

[54] RECORDING MEDIUM

[75] Inventors: Kenichi Moriya, Tokyo; Akio Kashiwazaki, Yokohama, both of Japan

[73] Assignee: Canon Kabushiki Kaisha, Tokyo, Japan

[21] Appl. No.: 08/951,634

[22] Filed: Oct. 17, 1997

Related U.S. Application Data

[63] Continuation of application No. 08/501,922, Jul. 13, 1995, abandoned.

[30] Foreign Application Priority Data

Jul. 18, 1994 [JP] Japan ..... 6-165292

[51] Int. Cl.[7] ..... B41M 5/00

[52] U.S. Cl. ..... 428/522; 428/195; 428/211; 428/478.2; 428/480; 428/481; 428/500; 428/524; 428/530; 428/532; 428/537.5

[58] Field of Search ..... 428/195, 500, 428/520, 522, 211, 478.2, 480, 481, 524, 530, 532, 537.5

[56] References Cited

U.S. PATENT DOCUMENTS 4,547,405 10/1985 Bedell et al. ..... 427/256

4,877,680 10/1989 Sakaki et al. ..... 428/195

FOREIGN PATENT DOCUMENTS

| | | |
|---|---|---|
| 57-93193 | 6/1982 | Japan . |
| 59-95188 | 6/1984 | Japan . |
| 59-185690 | 10/1984 | Japan . |
| 60-171143 | 9/1985 | Japan . |
| 60-220750 | 11/1985 | Japan . |
| 61-10483 | 1/1986 | Japan . |
| 61-189985 | 8/1986 | Japan . |
| 61-235182 | 10/1986 | Japan . |
| 62-009988 | 1/1987 | Japan . |
| 62-170383 | 7/1987 | Japan . |
| 63-115779 | 5/1988 | Japan . |
| 63-162274 | 7/1988 | Japan . |
| 63-221077 | 9/1988 | Japan . |
| 6-136310 | 5/1994 | Japan . |

*Primary Examiner*—Pamela R. Schwartz
*Attorney, Agent, or Firm*—Fitzpatrick, Cella, Harper & Scinto

[57] ABSTRACT

A recording medium has an ink-receiving layer. The layer comprises a hydrophilic resin, and a block copolymer of polyvinyl alcohol and a hydrophobic polymer. The ratio by weight of the hydrophilic resin to the block copolymer is in a range of from 100:1 to 1:1.

14 Claims, 3 Drawing Sheets

RECORDING MEDIUM

This application is a continuation of application Ser. No. 08/501,922 filed Jul. 13, 1995, now abandoned.

BACKGROUND OF THE INVENTION

1. Field of the Invention

The present invention relates to a recording medium suitable for use in ink-jet recording, and also to an image-forming method and a printed article using the medium.

2. Description of the Related Art

An ink-jet recording method is employed to perform recording based on the principle that small droplets of ink are produced to be ejected and entirely or partially attach to a material to be recorded, such as paper, a plastic film coated with an ink-receiving layer, or the like. Recording using the above-mentioned method is performed by the following various ink-ejection processes: ink is electrostatically sucked; mechanical vibration or displacement is provided for ink by use of piezoelectric elements; ink is heated to foam during which a pressure is produced and utilized; and other processes. Attention has been paid to such an ink-jet recording method employed whereby high-speed printing and multi-color printing can be realized, producing very little noise.

Ink used in the ink-jet recording method generally contains water as the main component for reasons of safety and recording characteristics. The ink, in many cases, also contains polyhydric alcohols with a view to preventing clogging of the nozzle and improving ejection stability.

Conventionally, recording media for use in ink-jet recording include: recording paper provided with a coating layer formed on a base paper, which layer contains pulverized silica and a water-soluble binder, such as polyvinyl alcohol or the like, as disclosed in Japanese Patent Publication No. 3-26665; glossy paper provided with a coating formed on cast coated paper, which coating contains polyvinyl alcohol having a degree of saponification of from 50 to 90 mole percent and a crosslinking agent, as disclosed in Japanese Patent Publication No. 3-25352; and over-head projector (OHP) recording sheets provided with a hydrophilic coating formed on a polyester film, which coating contains water-soluble polyvinyl alcohol having a degree of saponification of from 70 to 90 mole percent, as disclosed in Japanese Patent Laid-Open No. 60-220750.

In view of increasing improvements in the performance of ink-jet recording apparatuses, such as higher speed recording and multicolored printing, there is now an increasing need for ink-jet recording media having a better and wider range of characteristics, that is, a need for satisfying all the following characteristics at the same time.

(1) High absorbency with respect to ink (large absorption capacity and high absorption speed with respect to ink);
(2) High optical density of dots and no blurring at their periphery;
(3) Increased roundness of dot shape and smoothness at the periphery of the dots;
(4) Good stability of maintaining the image's quality for a long period without deterioration (in particular, in an environment of high temperature and high humidity);
(5) Inhibiting changes in characteristics in response to changes in temperature and humidity, and preventing curling;
(6) Lack of blocking; and
(7) Good stability of maintaining the quality of the recording medium for a long period without deterioration (in particular, in an environment of high temperature and high humidity).

With respect to OHP recording sheets and the like, there is a further need for excellent transparency of the recording medium.

These characteristics are, in many cases, trade-offs with each other, and it is thus difficult to satisfy all the characteristics at the same time by conventional techniques.

For example, the conventional recording media which have been described above by way of example have reasonably good characteristics, such as dot shape and blocking-resistance properties. However, they are insufficient in absorbency with respect to ink, thus causing ink to overflow in portions having higher image density, i.e., portions to which a larger quantity of ink is directed, which further results in images stained with ink and gives rise to inconsistencies in density. In particular, when color printing is performed, different colored stains occur due to color mixture in the boundaries between different colors.

Recently, there has been a report on the use of black ink and color ink having different surface tensions, in order to inhibit bleeding between black and other colors, as disclosed in Japanese Patent Laid-Open No. 6-136310. However, there are very few recording media exhibiting good recording characteristics for these different types of ink.

In further consideration of other characteristics, such as ink drying time and the like, there is not yet a recording medium which completely satisfies all the characteristics required of an OHP film.

Along with higher speeds of ink-jet recording, higher image densities, improved multi-colored printing, and increasing varieties of ink, come serious problems of long ink drying time, and decreases in image quality and shelf stability of the printed article.

A recording medium provided with an ink-receiving layer formed of polyvinyl pyrrolidone as a main component, as disclosed in Japanese Patent Publication No. 3-29596, has comparatively good ink absorbency in an environment of ordinary temperature and humidity. However, it takes an extremely long time for the ink to dry in an environment of high temperature and high humidity, which further encourages the occurrence of blocking. Also, the recording medium's recording surface has a low mechanical strength and is thus vulnerable to flaws.

The foregoing recording medium provided with an ink-receiving layer formed of polyvinyl alcohol as a main component has comparatively good blocking-resistance characteristics and good mechanical strength of its recording surface. However, after the recording medium has been left for a long time in an environment of high temperature and high humidity, the quality of the medium and its absorbency with respect to ink deteriorate. Also, after an image has been left for a long time in an environment of high temperature and high humidity, dot bleeding occurs, causing a deterioration in image sharpness.

Further, as disclosed in Japanese Patent Laid-Open No. 63-221077, polyvinyl acetal is used as a component of an ink-receiving layer. This can solve the problem of ink absorbency to some extent, but the image sharpness is far from satisfactory, particularly after a recorded image is left for a long time in an environment of high temperature and high humidity.

According to the foregoing recording method in which black ink and color ink having different physical properties, such as surface tension and the like, are used, cation-modified polyvinyl alcohol is used as a component of the ink-receiving layer, as disclosed in Japanese Patent Laid- Open Nos. 61-10483, 60-171143 and 61-235182. Such polyvinyl alcohol is used to obtain considerably satisfactory printing characteristics. However, characteristics other than image, such as ink drying time, tackiness on the surface of the ink-receiving layer and the like, are not sufficiently improved.

Still further, as disclosed in Japanese Patent Laid-Open Nos. 59-95188, 57-93193 and 62-170383, a hydrophilic resin emulsion is used as a component of an ink-receiving layer. However, none of the compositions of the ink-receiving layers specified in the above patent publications can completely solve the above-described problems. Among others, there is still a deterioration in image quality, which is the most important factor, such as ink stains on image and density inconsistencies caused by overflowing ink, particularly in portions having higher image density, that is, portions where a larger amount of ink is used.

SUMMARY OF THE INVENTION

Accordingly, an object of the present invention is to provide a recording medium which satisfies all the above-described characteristics at the same time in a well-balanced manner and to provide an image-forming method and a printed article using the medium.

Another object of the present invention is to provide a recording medium which does not deteriorate even after the recording medium or an image formed thereon has been left for a long time in an environment of high temperature and high humidity and which has a short ink drying time and excellent properties of carrying recorded matter, and also to provide an image-forming method and a printed article using such a recording medium.

In order to achieve the above objects, the present invention provides a recording medium comprising a base and an ink-receiving layer provided on at least one surface of the base, the ink-receiving layer comprising a hydrophilic resin, and a block copolymer of polyvinyl alcohol and a hydrophobic polymer, wherein the block copolymer is contained in an amount of from one part or more to less than 100 parts to 100 parts by weight of the hydrophilic resin.

The present invention also provides a method of forming an image on the above-described recording medium, wherein the recording method is performed by allowing ink to be ejected from an orifice of a recording head according to a recording signal.

The present invention further provides a printed article obtained by forming an image on the above-described recording medium.

Further objects, features and advantages of the present invention will become apparent from the following description of the preferred embodiments with reference to the attached drawings.

DETAILED DESCRIPTION OF THE PREFERRED EMBODIMENTS

Figure 1:
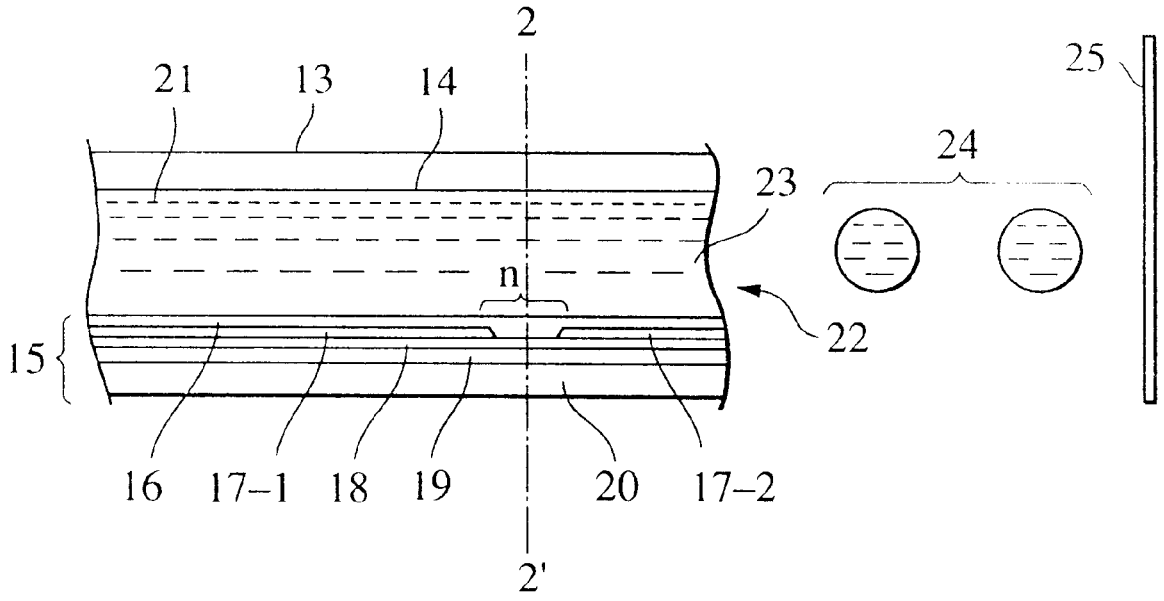
FIG. 1 is a longitudinal sectional view of a head used in an ink-jet recording apparatus.

In the process of developing a recording medium suitable for ink-jet recording, such as recording papers, and transparency films for use in over-head projectors, the present inventors found that a recording medium provided with a coating having the above-described composition exhibits the following characteristics. The recording medium has a remarkably good absorbency with respect to ink, presents clear and sharp dots, and is excellent in blocking-resistance properties. Further, changes in characteristics of the medium are minimized in response to changes in environmental conditions, such as temperature and humidity. In particular, the medium is stable in maintaining its quality for a long period in an environment of high temperature and high humidity. It is also possible to form an image whose quality can be maintained stably for a long time in an environment of high temperature and high humidity. Moreover, the recording medium has a short ink drying time and excellent printed-matter carrying characteristics.

An ink-receiving layer contains a hydrophilic resin so as to improve affinity with ink having various characteristics, in particular, affinity with water and water-miscible glycols or glycol ethers. Thus, there is an improvement in the ink absorbency of the layer, thus presenting clear dots and a sharp image. Additionally, changes in characteristics of the medium in response to a change in environmental conditions, such as temperature and humidity, can be minimized.

In order to solve the problems inherent in a hydrophilic resin, such as ink drying time and recorded-matter carrying properties, the ink-receiving layer further contains a block copolymer of polyvinyl alcohol and a hydrophobic polymer which remarkably improves the above-described characteristics to provide an excellent OHP film.

A detailed description will now be given of the present invention with reference to a preferred embodiment.

A block copolymer of polyvinyl alcohol and a hydrophobic polymer used in the present invention is supplied mainly in the form of an aqueous dispersion. The block copolymer presents a mixture of various characteristics in different portions, that is, ink affinity in the polyvinyl alcohol, film mechanical properties in the hydrophobic monomer, and resistance to harsh environments, thus obtaining the advantages of the present invention.

Although unmodified polyvinyl alcohol is mainly used as the polyvinyl alcohol, cation-modified or anion-modified polyvinyl alcohol may be used instead.

Hydrophobic monomers used in a hydrophobic polymer particularly, but not exclusively, include aromatic vinyl compounds, such as styrene, methylstyrene, vinylnaphthalene, and the like, unsaturated carboxylate esters such as (meth)acrylate, crotonate or the like, vinyl acetate, vinyl butyrate, and the like.

Among others, styrene and (meth)acrylate are preferable because they can achieve high compatibility among printing properties, image quality, blocking resistance, and recorded-matter carrying properties with respect to various types of ink.

The ratio of the degree of polymerization of polyvinyl alcohol to a hydrophobic polymer, both of which form a block polymer of the present invention, preferably falls within a range of from 1:10 to 20:1. The weight average molecular weight of the block polymer preferably falls within a range of from about 500 to about 1,000,000.

Hydrophilic resins used in the present invention include water-soluble resins and water-dispersed resins.

Any resin can be used as a water-soluble resin as long as it can accept, what is known as, water-based ink, and exhibits solubility or affinity with respect to water-based ink. The water-soluble resins include particularly, but not exclusively: synthetic resins, such as unmodified polyvinyl alcohol, anion-modified polyvinyl alcohol, cation-modified polyvinyl alcohol, polyurethane, carboxymethylcellulose, polyester, polyacrylate (ester), hydroxymethyl cellulose, hydroxyethyl cellulose, melamine resin, or denatured compounds of these resins, and the like; and natural resins, such as albumin, gelatin, casein, starch, cationic starch, gum arabic, sodium alginate, and the like.

Water-dispersed resins include particularly, but not exclusively, polyvinyl acetate, ethylene-vinyl acetate copolymer, polystyrene, styrene-(meth)acrylate copolymer, (meth)acrylate copolymer, vinyl acetate-(meth)acrylate (ester) copolymer, poly(meth)acrylamide, (meth)acrylamide copolymer, styrene-isoprene copolymer, styrene-butadiene copolymer, ethylene-propylene copolymer, polyvinyl ether, silicone-acrylic copolymer, and the like. Copolymers containing a unit, such as N-methylolacrylamide or the like and thus having self-crosslinking properties may also be employed. These hydrophilic resins may be used singly or as a mixture of a plurality of resins.

The content of a block copolymer of polyvinyl alcohol and a hydrophobic polymer in terms of solids by weight is preferably one part or over, but less than 100 parts, in relation to 100 parts by weight of the above-described hydrophilic resin. If the block copolymer is less than one part, the resulting recording medium does not exhibit a sufficiently short ink drying time, satisfactory recorded-matter carrying properties, and the like. On the other hand, 100 parts or more of the block copolymer causes an extremely high degree of haze in the resulting film and further causes poor quality and insufficient shelf stability of the recorded image.

In the present invention, a cationic compound may further be added for improving the shelf stability of the image.

Cationic compounds are not particularly limited as long as they contain cationic properties in the molecules thereof. They include particularly, but not exclusively: quaternary ammonium type cationic surfactants, such as monoalkyl ammonium chloride, dialkyl ammonium chloride, tetramethyl ammonium chloride, trimethylphenyl ammonium chloride, ethylene oxide-added ammonium chloride or the like; amine-type cationic surfactants; and amphoteric surfactants having cationic properties, such as alkylbetaine, imidazolimium betaine, alanines and the like.

Cationic compounds as monomers or oligomers include cation-denatured compounds of polyacrylamide, copolymers of acrylamide and cationic monomers, polyarylamine, polyamine sulfone, polyvinyl amine, polyethyleneimine, polyamido-epichlorohydrin resin, polyvinyl pyridinium halide, and the like.

Additionally, vinyloxazolidine monomers may be used singly, or a copolymer of the above monomer and the other general types of monomers may be used. Further, vinylimidazol monomers may be used singly, or a copolymer of the above monomer and the other types of monomer may be employed.

The other monomers of the above-mentioned types include methacrylate, acrylate, acrylnitrile, vinyl ether, vinyl acetate, ethylene, styrene and the like. Cation-denatured cellulose may also be used.

The above types of cation-denatured compounds are preferably used, but they are certainly not exclusive.

The content of the cationic compounds in the ink-receiving layer preferably falls within a range of from 0.01 to 30 percent by weight in relation to the content of the hydrophilic resin in the layer. If the content of the cationic compounds is less than 0.01 percent by weight, the resulting ink-receiving layer does not form images which have noticeably longer shelf stability in an environment of high temperature and high humidity than an ink-receiving layer with no cationic compound at all. On the other hand, if the content of the cationic compounds exceeds 30 percent by weight, the resulting ink-receiving layer has excessively high absorbency, which promotes blocking, and the recording surface has low mechanical strength and is thus vulnerable to flaws.

In the present invention, the cationic compounds are not essential, but merely optional.

Moreover, crosslinking agents may be included: such as methylol melamine, methylol urea, methylol hydroxypropylene urea, isocyanate and the like, which are merely illustration.

In the present invention, a composition of the above-described hydrophilic resin and block copolymer of polyvinyl alcohol and a hydrophobic polymer is applied to at least one surface of a base, resulting in a recording medium having an ink-receiving layer formed on the surface of the base. Various fillers and additives may be contained in the composition as long as they do not hamper the achievement of the objects of the present invention.

Fillers include specifically, but not exclusively, silica, alumina, aluminium silicate, magnesium silicate, basic magnesium carbonate, talc, hydrotalcite, calcium carbonate, titanium oxide, zinc oxide, and plastic pigments such as polyethylene, polystyrene, polyacrylate and the like.

Additives include specifically, but not exclusively, various types of surfactants, dye fixing agents (hydration-resisting agents), defoaming agents, antioxidants, fluorescent brightening agents, UV absorbents, dispersants, viscosity adjustor, pH adjustor, fungicide, plasticizer and the like. These additives may be selected from conventional compounds as desired according to the intended purpose.

Bases for the recording medium of the present invention, include specifically, but not exclusively: paper, such as wood free paper, intermediate grade paper, art paper, bond paper, recycled paper, baryta paper, cast-coated paper, corrugated card board, and the like; plastic films, such as polyethylene terephthalate, diacetate, triacetate, cellophane, celluloid, polycarbonate, polyimide, polyvinyl chloride, polyvinylidene chloride, polyacrylate, polyethylene, polypropylene, and the like; a plate, such as a glass plate and the like; and cloth, such as cotton, rayon, acrylic fiber, nylon, silk, polyester and the like. The base material can be suitably selected according to various conditions, such as the intended use of the resulting recording medium and recorded image, and adhesion of the base to the composition to be applied to the top of the base.

For example, a translucent material, such as a plastic film or the like, may be selected as the base to form an OHP film, while an opaque material, such as paper or the like, may be selected as the base to form glossy paper.

In the formation of the recording medium of the present invention, the foregoing composition is first dissolved or dispersed singly or with other additives if required, in water or an organic solvent, such as alcohol, polyhydric alcohols, or other types of suitable solvents. A coating liquid is thus prepared.

The thus-obtained coating liquid is applied to a surface of the base according to any of the following processes: roll coater, blade coater, air knife coater, Gate roll coater, bar coater, size press coating, spray coating, gravure coating, curtain coating and the like. Then, the liquid coating is dried in, for example, a hot-air drying oven, a heat drum or the like. The recording medium of the present invention is thus obtained.

The total amount of coating to form the ink-receiving layer is preferably in a range of from 0.2 to 50 g/m$^2$, and more preferably, in a range of from 1 to 30 g/m$^2$. It is acceptable that the base may be exposed if it is coated with only a small amount of liquid. If the amount of coating is less than 0.2 g/m$^2$, the resulting recording medium does not sufficiently improve the coating's color developing properties, in comparison with a recording medium with no ink-receiving layer at all. On the other hand, an amount of coating in excess of 50 g/m$^2$ increases the occurrence of curling, particularly in an environment of low temperature and low humidity. The suitable amount of coating in terms of thickness is preferably in a range of from 0.5 to 100 $\mu$m.

Known types of ink can be employed in performing ink-jet recording on the above-described recording medium without problems. Usable recording agents include water-soluble dye, such as direct dye, acid dye, basic dye, reactive dye, food dye and the like, disperse dye, and pigments. Any general type of dye for use in ink-jet recording can also be used without any particular restriction. Such water-soluble dyes, disperse dyes or pigments usually make up in a range of approximately from 0.1 to 20 percent by weight of conventional ink. A ratio similar to this can apply to the present invention.

As a solvent used in water-based ink for the present invention, water or a solvent mixture of water and a water-soluble organic solvent may be used. The solvent mixture is more preferable, particularly one containing water-miscible glycols or glycol ethers as a water-soluble organic solvent, such solvent preventing the ink from drying.

Ink-jet recording on the recording medium of the invention may be performed with color inks as well as with black ink. For example, the ink ejected onto the recording medium may include a plurality of inks, such as cyan ink, magenta ink, yellow ink and black ink. When black ink is used together with one or more color inks, it is preferable that the surface tension of the black ink be greater than the surface tension of the color ink or inks.

A method of performing recording by providing the ink to the foregoing recording medium preferably employs an ink-jet recording method. Any process may be employed to effect such ink-jet recording method as long as ink is effectively ejected from a nozzle onto the recording medium. In particular, an ink-jet recording method disclosed in Japanese Patent Laid-Open No. 54-59936 may be effectively employed. In this method, ink is acted upon by thermal energy, which abruptly changes the volume of the ink. Through this transformation, the ink is ejected from a nozzle.

Figure 2:
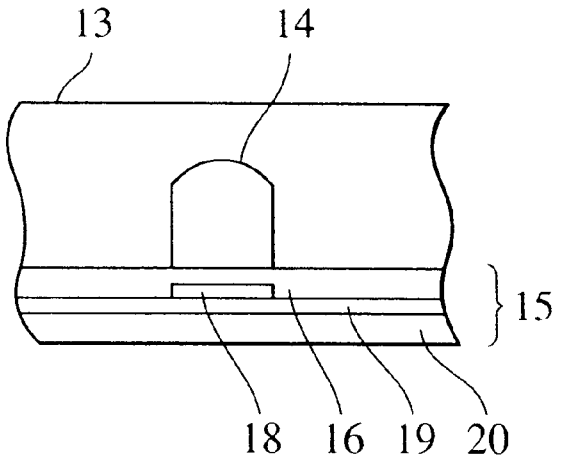
FIG. 2 is a cross-sectional view of the head section as shown by line 2—2' in the ink-jet recording apparatus of FIG. 1.
Figure 3:
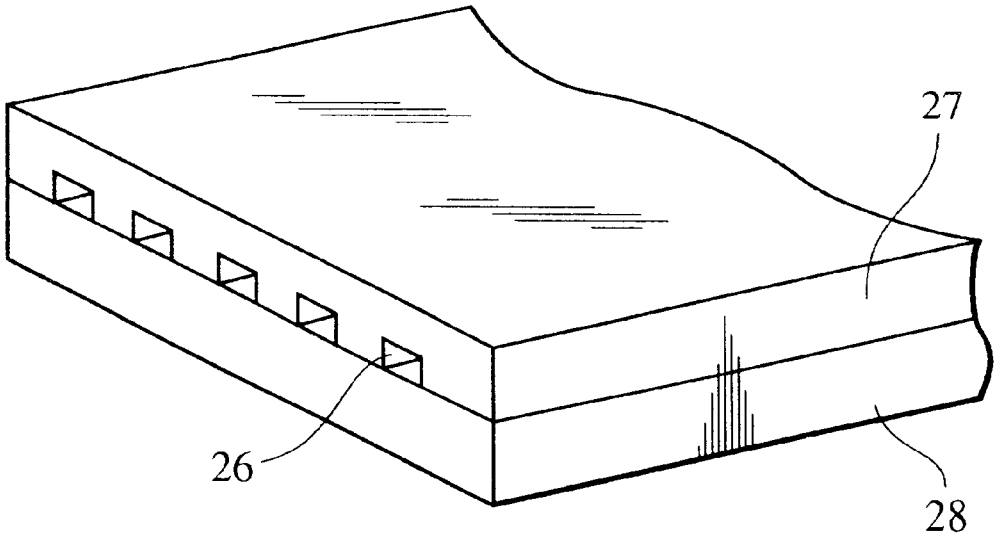
FIG. 3 is a perspective view of the exterior of a head used in an ink-jet recording apparatus.

An explanation will now be given of a suitable example of ink-jet recording apparatuses for performing recording using the recording medium of the present invention. FIGS. 1, 2 and 3 respectively illustrate an example of the construction of a head, which is the main element of such an apparatus.

A head 13 can be obtained by bonding a glass, ceramic or plastic plate, which is provided with a groove 14 for receiving ink, to a heating head 15 used in thermal recording. (The head shown is merely for representation but the invention is not restricted thereto.) The heating head 15 comprises a protective film 16 formed of silicon oxide or the like, aluminum electrodes 17-1 and 17-2, a heating resistive element layer 18 formed of nichrome or the like, a heat accumulation layer 19, and a substrate 20 formed of alumina having good heat dissipating characteristics, or the like.

Ink 21 fills the groove 14 just before the tip of an ejection orifice (consisting of microfine pores) 22 to form a meniscus 23 by the action of pressure.

Upon application of an electric signal to the electrodes 17-1 and 17-2, an area indicated by n in FIG. 1 of the heating head 15 is abruptly heated so as to cause the ink 21 in contact with area n to generate bubbles. Then, the meniscus 23 is projected by the pressure of the bubbles so that the ink 21 is ejected and transformed into small droplets 24 through the orifice 22 and flies toward a medium to be recorded 25. FIG. 3 is an exterior view illustrative of a multi-head system obtained by combining a plurality of the heads shown in FIG. 1. The multi-head system is produced by bringing a glass plate 27 provided with multigrooves 26 into a close contact with a heating head 28 similar to that shown in FIG. 1.

FIG. 1 is a sectional view illustrative of the head 13 along an ink flow passage. FIG. 2 is a cross-sectional view along line 2-2' of FIG. 1.

Figure 4:
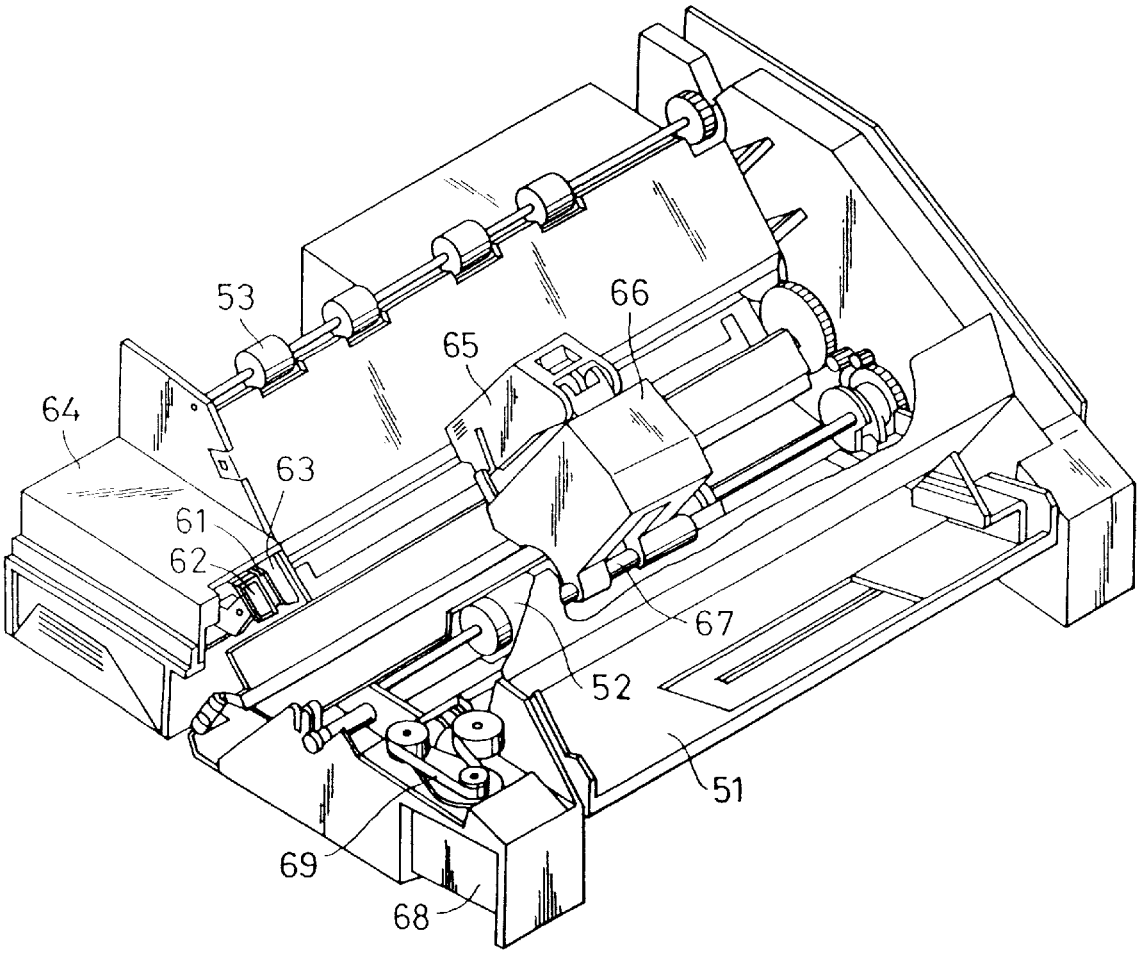
FIG. 4 is a perspective view of one example of an ink-jet recording apparatus.

FIG. 4 illustrates one example of an ink-jet recording apparatus into which such a head has been incorporated.

Referring to FIG. 4, a blade 61, which serves as a wiping member, one end of which is a stationary end held by a blade holding member to form a cantilever. The blade 61 is provided at a position adjacent to the region in which the recording head operates, and in this embodiment, is constructed in such a manner that it moves in the direction perpendicular to the movement of the head and comes into contact with the face of the ejection openings to cap it. An ink absorbing member 63 is provided adjoining blade 61, and, similar to the blade 61, is held in such a position that it moves in the direction perpendicular to the movement of the head. The above-described blade 61, cap 62 and ink-absorbing member 63 constitute an ejection recovery portion 64, where the blade 61 and the absorbing member 63 remove water, dust and/or the like from the ink ejection opening face.

A recording head 65 has ejection-energy-generating means and performs recording by ejecting the ink onto a recording medium opposedly facing the ejection opening face, which is provided with ejection openings. A carriage 66 has the recording head 65 mounted thereon so that head 65 can be moved. The carriage 66 is slidably interlocked with a guide rod 67 and is partially connected to a belt 69 driven by a motor 68 (connecting state is not shown). With this construction, the carriage 66 is movable along the guide rod 67 so that the recording head 65 mounted on the carriage 66 can be moved from a recording region to a region adjacent thereto.

The recording apparatus also comprises a paper feeder 51 through which a recording medium is inserted and a paper feed roller 52 which is driven by a motor (not shown). With this construction, a recording medium is fed to the position opposedly facing the ejection opening face of the recording head 65, and is discharged through a paper discharge roller 53 with the progress of recording.

With this arrangement, when the recording head 65 returns to its home position, for example, upon completion of recording, the cap 62 in the head recovery portion 64 is retracted from the path of movement of the recording head 65, while the blade 61 remains protruded into the path of movement. As a result, the ejection opening face of the recording head 65 is wiped by the blade 61. When the cap 62 comes into contact with the ejection opening face of the head 65 to cap it, the cap 62 is moved so as to protrude into the path of movement of the recording head 65.

When the recording head 65 is moved from its home position to the position at which recording is started, the cap 62 and the blade 61 are placed in the same positions they are in during the wiping described above. As a consequence, the ejection opening face of the recording head 65 is also wiped by the blade 61 during this movement.

The above movement of the recording head to its home position occurs not only when recording is completed and during discharge recovery of the head, but also when the recording head is moved between recording regions for the purpose of recording, during which it is moved to the home position adjacent to each recording region at given intervals, where the ejection opening face is wiped in accordance with this movement.

The present invention will be explained further in more detail with reference to the following examples. Unless otherwise specified, "part(s)" and "percent" used in the following examples indicate part(s) by weight and percent by weight, respectively.

EXAMPLE 1

A composition comprising 100 parts of polyvinyl alcohol (trade name PVA217, produced by Kuraray Co., Ltd., having a degree of polymerization of approximately 1700 and a degree of saponification of approximately 88 mole %) and 20 parts of a block polymer A of polyvinyl alcohol and polystyrene (PVA/PSt=100/10, the PVA having a degree of polymerization of approximately 1500 and a degree of saponification of approximately 86 mole %) was dissolved or dispersed in water as a solvent, followed by mixing them.

The thus-obtained coating liquid was applied by use of a wire bar to a polyethylene terephthalate film (having a thickness of 100 $\mu$m, trade name Lumirror, produced by Toray Industries, Co.) so that the thickness of the coating would become 10 $\mu$m after drying. Subsequently, the resultant coating was dried at 120° C. for three minutes. The recording medium of the present invention was thus prepared.

Color printing was performed on the above-described recording medium by use of an ink-jet recording apparatus wherein ink was foamed by means of thermal energy, and thus ejected. Such color printing was performed using ink having the following composition.

| Ink composition: BK | (by part) |
|---|---|
| C.I. Direct Black 19 | 3 |
| Glycerol | 6 |
| Ethylene glycol | 5 |
| Urea | 5 |
| Isopropyl alcohol | 3 |
| Water | 78 |

The surface tension of this type of ink was approximately 45 dyne/cm.

| Ink composition: Y, M, C | (by part) |
|---|---|
| Dye | 3 |
| Glycerol | 7 |
| Thiodiglycol | 7 |
| Urea | 7 |
| Acetylene glycol | 1.5 |
| Water | 74.5 |

The surface tension of this type of ink was approximately 35 dyne/cm.

| Dye used in printing | |
|---|---|
| Y: C.I. Direct Yellow 86 | |
| M: C.I. Acid Red 23 | |
| C: C.I. Direct Blue 199 | |
| Printing conditions: | |
| Ejection frequency: | 4 KHz |
| Volume of ejection droplet: | 45 pl |
| Printing density: | 360 dpi (dots per inch) |
| Maximum volume in which single color ink is provided: | 8 nl/mm$^2$ |

Maximum volume in which single color ink is provided: 8 nl/mm$^2$

EXAMPLE 2

A recording medium was formed to perform color printing in a manner similar to Example 1, except that the block polymer A was substituted by a block polymer B of polyvinyl alcohol and polystyrene (PVA/PSt=100/10, the PVA having a degree of polymerization of approximately 1600 and a degree of saponification of approximately 99 mole %).

EXAMPLE 3

A recording medium was formed to perform color printing in a manner similar to Example 1, except that the block polymer A was substituted by a block polymer C of polyvinyl alcohol and polystyrene (PVA/PSt=100/40, the PVA having a degree of polymerization of approximately 1600 and a degree of saponification of approximately 99 mole %).

EXAMPLE 4

A recording medium was formed to perform color printing in a manner similar to Example 1, except that the block polymer A was substituted by a block polymer D of polyvinyl alcohol and polystyrene (PVA/PSt=100/20, the PVA having a degree of polymerization of approximately 450 and a degree of saponification of approximately 97 mole %).

EXAMPLE 5

A recording medium was formed to perform color printing in a manner similar to Example 1, except that the block polymer A was substituted by a block polymer E of polyvinyl alcohol and polystyrene (PVA/PSt=100/10, the PVA having a degree of polymerization of approximately 1500 and a degree of saponification of approximately 88 mole %).

EXAMPLE 6

A recording medium was formed to perform color printing in a manner similar to Example 1, except that the block polymer A was substituted by a block polymer F of polyvinyl alcohol and polystyrene (PVA/PSt=100/20, the PVA having a degree of polymerization of approximately 1600 and a degree of saponification of approximately 99 mole %).

EXAMPLE 7

A recording medium was formed to perform color printing in a manner similar to Example 1, except that the block polymer A was substituted by a block polymer G of polyvinyl alcohol and polymethylmethacrylate (PVA/PMMA=100/20, the PVA having a degree of polymerization of approximately 1600 and a degree of saponification of approximately 99 mole %).

EXAMPLE 8

A recording medium was formed to perform color printing in a manner similar to Example 1, except that polyvinyl alcohol (PVA217) was substituted with hydroxyethyl cellulose (trade name AL-15, produced by Fuji Chemical Co., Ltd.).

EXAMPLE 9

A recording medium was formed to perform color printing in a manner similar to Example 1, except that polyvinyl alcohol (PVA217) was substituted with polyvinyl acetal (trade name KW-1, produced by Sekisui Chemical Co., Ltd.).

EXAMPLE 10

A recording medium was formed to perform color printing in a manner similar to Example 1, except that polyvinyl alcohol (PVA217) was substituted with cation-modified polyvinyl alcohol (trade name CM-318, produced by Kuraray Co., Ltd., having a degree of polymerization of approximately 1700, a degree of saponification of approximately 89 mole %, and a degree of cationization of 2 mole %)

EXAMPLES 11 to 13

A recording medium was formed to perform color printing in a manner similar to Example 1, except that art paper (Example 11), wood-free paper (Example 12), and an acrylic sheet (Example 13) were used as the bases.

COMPARATIVE EXAMPLE 1

A recording medium was prepared to perform color printing in a manner similar to Example 1, except that a hydrophilic resin was not used, and only the block polymer A of polyvinyl alcohol and polystyrene (PVA/PSt=100/10, the PVA having a degree of polymerization of approximately 1500 and a degree of saponification of approximately 86 mole %) was employed.

COMPARATIVE EXAMPLE 2

A recording medium was formed to perform color printing in a manner similar to Example 1, except that a hydrophilic resin was not used, and only the block polymer D of polyvinyl alcohol and polystyrene (PVA/PSt=100/20, PVA having a degree of polymerization of approximately 450 and a degree of saponification of approximately 97 mole %) was employed.

COMPARATIVE EXAMPLE 3

100 parts of polyvinyl alcohol (trade name PVA217, produced by Kuraray Co., Ltd., having a degree of polymerization of approximately 1700 and a degree of saponification of approximately 88 mole %) and 200 parts of a block polymer A of polyvinyl alcohol and polystyrene (PVA/PSt=100/10, the PVA having a degree of polymerization of approximately 1500 and a degree of saponification of approximately 86 mole %) were mixed to prepare a liquid. A recording medium was formed to perform color printing in a manner similar to Example 1.

COMPARATIVE EXAMPLE 4

100 parts of polyvinyl alcohol (trade name PVA217, produced by Kuraray Co., Ltd., having a degree of polymerization of approximately 1700 and a degree of saponification of approximately 88 mole %) and 0.1 parts of a block polymer A of polyvinyl alcohol and polystyrene (PVA/PSt=100/10, the PVA having a degree of polymerization of approximately 1500 and a degree of saponification of approximately 86 mole %) were mixed to prepare a liquid. A recording medium was formed to perform color printing in a manner similar to Example 1.

COMPARATIVE EXAMPLE 5

A recording medium was formed to perform color printing in a manner similar to Example 1, except that a block copolymer of polyvinyl alcohol and a hydrophobic polymer was not used, and only polyvinyl alcohol (trade name PVA217, produced by Kuraray Co., Ltd., having a degree of polymerization of approximately 1700 and a degree of saponification of approximately 88 mole %) was employed.

Evaluations were made on the thus-obtained color print samples with respect to the following factors. The results are shown in Table 1.

(1) Ink drying time

Recording was performed in full-dot printing with two inks of a black color and a yellow, cyan or magenta color in an environment of 25° C./60%RH. The resultant samples were left for two minutes. Then, PB Paper (produced by Canon Inc.) was overlaid on two full-dot printed areas with black ink and color ink i.e., yellow, cyan or magenta ink and was scrubbed under a pressure of 4 kg/cm$^2$. The paper was then removed from the samples. The test results are shown in Table 1 by the following categories: samples in which ink was obviously transferred to paper are indicated by C; those in which ink was slightly transferred to paper are represented by B; and those in which ink transfer was not detectable whatsoever are designated by A.

(2) Tackiness

The ink-receiving layer was touched with a hand to determine tackiness. The results are shown in Table 1 by the following categories: samples with a sense of tackiness are indicated by C; those with a sense of slight tackiness are represented by B; and those without any sense of tackiness are designated by A.

(3) Shelf stability of recorded image

The color samples were left in an environment of 30° C./80%RH for seven days. The characteristics of the resultant samples were compared with their characteristics before they had been left. The results are shown in Table 1 by the following categories: samples in which there was a considerable deterioration in image quality, such as bleeding, character-thickening, and character compression in which white figures were darkened (18 point, Minchotai) are indicated by C; those which suffered from the above disadvantages but were readable are represented by B; and those which did not present any problem are designated by A.

(4) Image quality

Visual observations were made to evaluate the color print samples with respect to optical density, gradation and sharpness of image. The results are shown in Table 1 by the following categories: samples which were superior in the above characteristics are indicated by A; those which were slightly inferior in the above characteristics are represented by B; and those which obviously had a low optical density and a small level of gradation and were lacking in sharpness are designated by C.

(5) Bleeding between black and other types of color

In Table 1, samples in which bleeding obviously occurred at the boundaries between black and other types of color are indicated by C; those in which bleeding slightly occurred are represented by B; and those without bleeding whatsoever are designated by A.

TABLE 1

| | Ink drying time | | | Image shelf | Image | Bleeding between black |
|---|---|---|---|---|---|---|
| | Black | Color | Tackiness | stability | quality | and other colors |
| Example 1 | A | A | A | A | A | A |
| Example 2 | A | A | A | A | A | A |
| Example 3 | A | B | A | A | A | A |
| Example 4 | A | A | A | B | A | A |
| Example 5 | A | A | A | A | A | A |
| Example 6 | A | A | A | A | A | A |
| Example 7 | A | A | A | A | A | A |
| Example 8 | A | B | A | A | A | A |
| Example 9 | A | A | A | A | A | A |
| Example 10 | A | A | A | A | A | A |
| Example 11 | A | A | A | A | A | A |
| Example 12 | A | A | A | A | A | A |
| Example 13 | A | A | A | A | A | A |
| Comp. Example 1 | A | A | A | C | C | B |
| Comp. Example 2 | A | A | A | C | B | B |
| Comp. Example 3 | A | A | A | C | C | B |
| Comp. Example 4 | C | C | B | A | A | A |
| Comp. Example 5 | C | C | B | A | A | A |

As will be clearly understood from the foregoing description, the present invention offers the following advantages.

It is possible to provide an ideal recording medium satisfying all the characteristics required, that is, having good absorbency with respect to various different inks, presenting sharp and clear dots having a high level of optical density, and also exhibiting a short ink drying time with respect to the ink-receiving layer. By use of such a medium, it is also possible to obtain an image having a higher level of definition and a greater range of gradation without bleeding. Further, there is no deterioration in recorded matter using such a medium even after it has been left for a long period in an environment of high temperature and high humidity.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording medium comprising a base and an ink-receiving layer provided on at least one surface of said base, said ink-receiving layer comprising polyvinyl alcohol as a hydrophilic resin, and a block copolymer of polyvinyl alcohol and a hydrophobic polymer, wherein the degree of polymerization of said polyvinyl alcohol contained in said block copolymer and the degree of polymerization of said hydrophobic polymer contained in said block copolymer are in a ratio within a range from 1:10 to 20:1, and said block copolymer is supplied in the form of an aqueous dispersion and is present in an amount ranging from one part to less than 100 parts, to 100 parts by weight of said hydrophilic resin.

2. A recording medium according to claim 1, wherein said base comprises a plastic film.

3. A recording medium according to claim 1, wherein said base comprises paper.

4. A recording medium according to claim 1, wherein a monomer forming said hydrophobic polymer is selected from the group consisting of aromatic vinyl compounds, unsaturated carboxylate esters, vinyl acetate, and vinyl butyrate.

5. A recording medium according to claim 1, wherein said block copolymer has a weight average molecular weight in a range of from about 500 to about 1,000,000.

6. A recording medium according to claim 1, wherein said hydrophobic polymer comprises a polymer selected from the group consisting of styrene, methylstyrene, vinylnaphthalene, acrylate, methacrylate, and crotonate.

7. A recording medium according to claim 1, wherein the total amount of coating to form said ink-receiving layer is in a range of from 0.2 to 50 $g/m^2$.

8. A recording medium according to claim 1, wherein said ink-receiving layer has a thickness of from 0.5 to 100 $\mu$m.

9. A recording medium comprising a base and an ink-receiving layer provided on at least one surface of said base, said ink-receiving layer comprising polyvinyl alcohol and a block copolymer of polyvinyl alcohol and a hydrophobic polymer selected from the group consisting of polystyrene and polymethylmethacrylate, wherein the degree of polymerization of said polyvinyl alcohol and the degree of polymerization of said hydrophobic polymer contained in said block copolymer are in a ratio within a range from 1:10 to 20:1, and said block copolymer is supplied in the form of an aqueous dispersion and is present in an amount ranging from one part to less than 100 parts, to 100 parts by weight of said polyvinyl alcohol.

10. A recording medium according to claim 9, wherein said base comprises a plastic film.

11. A recording medium according to claim 9, wherein said base comprises paper.

12. A recording medium according to claim 9, wherein said block copolymer has a weight average molecular weight in a range of from about 500 to about 1,000,000.

13. A recording medium according to claim 9, wherein the total amount of coating to form said ink-receiving layer is in a range of from 0.2 to 50 $g/m^2$.

14. A recording medium according to claim 9, wherein said ink-receiving layer has a thickness of from 0.5 to 100 $\mu$m.

* * * * *

UNITED STATES PATENT AND TRADEMARK OFFICE

CERTIFICATE OF CORRECTION

PATENT NO. : 6,096,440
DATED : August 1, 2000
INVENTOR(S) : Kenichi Moriya et al.

It is certified that error appears in the above-identified patent and that said Letters Patent is hereby corrected as shown below:

Column 10,
Lines 29 and 30 should be deleted.

Signed and Sealed this

Eleventh Day of June, 2002

*Attest:*

*Attesting Officer*

JAMES E. ROGAN
*Director of the United States Patent and Trademark Office*